US006086056A

United States Patent [19]

Leask et al.

[11] Patent Number: 6,086,056

[45] Date of Patent: Jul. 11, 2000

[54] FLOAT SINK HEADER

[76] Inventors: Jim Leask, #3 Neltner Drive, St. Andrews, Manitoba, Canada, R1A 3A4; Martin Hildebrand, 51 Evergreen Avenue, Mitchell, Manitoba, Canada, R5G 1H1

[21] Appl. No.: 09/069,446

[22] Filed: Apr. 29, 1998

[51] Int. Cl.[7] ..... B01F 3/04

[52] U.S. Cl. ..... 261/120; 261/121.1; 210/221.2; 210/242.2

[58] Field of Search ..... 261/120, 121.1, 261/122.1; 210/221.2, 242.2

[56] References Cited

U.S. PATENT DOCUMENTS

| | | | |
|---|---|---|---|
| 3,664,647 | 5/1972 | Snow et al. | 261/120 |
| 4,215,082 | 7/1980 | Danel | 261/120 |
| 4,287,060 | 9/1981 | Coggins | 261/120 |
| 4,820,457 | 4/1989 | Jager | 261/120 |
| 5,089,179 | 2/1992 | Von Nordenskjold | 261/120 |
| 5,316,671 | 5/1994 | Murphy | 261/120 |
| 5,354,457 | 10/1994 | Becchi | 261/120 |

FOREIGN PATENT DOCUMENTS

| | | | |
|---|---|---|---|
| WO 88/07977 | 10/1988 | WIPO | 210/242.2 |

*Primary Examiner*—C. Scott Bushey
*Attorney, Agent, or Firm*—Michael Williams; Adrian D. Battison; Murray E. Thrift

[57] ABSTRACT

An aeration header for mounting beneath the surface of a body of water is described. The header is formed by a first pipe arranged for transmitting the gas or fluid, a second buoyancy pipe arranged to hold either water or air and an elongate ballast pipe for adding weight to the header. In use, the header is laid out across the surface of a body of water and the first pipe is connected to a source of air. Water is then pumped into the second pipe, which displaces the air in the second pipe and increases the specific weight of the header, thereby causing the header to sink below the surface of the body of water. As the header is below the surface, water traffic is not restricted by the transfer of fluid across the body of water. For maintenance, compressed air is pumped into the second pipe, replacing the water in the second pipe and causing the header to float to the surface of the body of water. This arrangement may be used for aerating or de-icing bodies of water, such as, for example, lakes, channels and lagoons. The air is released from the supply pipe into air diffusion lines extending from the first supply pipe. In one arrangement, the diffusion lines extend outwardly to respective sides of the header and draped over the bottom. In another arrangement, the diffusion lines are parallel to the supply pipe.

7 Claims, 9 Drawing Sheets

FLOAT SINK HEADER

The following invention relates generally to methods for transmitting fluids or gases beneath the surface of a body of water.

BACKGROUND OF THE INVENTION

There are several difficulties associated with transferring fluids or gases such as oil, natural gas or air, across a body of water. As has been demonstrated, tanker ships are costly to operate, impractical for transporting small distances and potentially hazardous to the environment. Furthermore, laying pipelines across the surface of a body of water is clearly not a solution, as these above-water pipelines would pose significant obstacles to water traffic and also produce a great deal of noise. Similarly, pipelines permanently anchored to the bottom of the body of water are costly to install and even more costly to maintain and/or repair, requiring expensive deep sea welding to repair leaks.

However, there are several potential uses for underwater pipelines, such as, for example, transmitting gases and liquid hydrocarbons from off-shore gas and oil wells, super tanker loading and unloading in shallow or environmentally sensitive areas where regular port facilities are unavailable, and natural gas pipelines across oceans, lakes and rivers.

Similarly, the aeration of lakes and treatment of waste water is more effectively done by injecting compressed air into the body of water from beneath the surface of the body of water, that is, by an underwater aeration system. Specifically, using this method, no aerosols are produced which may be harmful and there is little noise produced. However, as with the fluid-transfer pipelines, these subsurface aeration pipelines are costly to maintain and/or repair. The prior art discloses several methods and devices that attempt to overcome this problem:

U.S. Pat. No. 4,273,732 teaches an apparatus for raising a liquid aeration apparatus. The apparatus comprises a carrier element which is guided by a guide device connected to boom arranged for engaging air distributing pipes beneath the surface of a body of water. This device is limited in that the location of the air distributing pipes must be known or visible in order for the pipes to be brought to the surface and a large boat must be used to support the boom. Finally, the device can only lift one section of the air distributing pipe at one time, making routine maintenance of the aeration system time consuming and expensive.

U.S. Pat. No. 5,587,114 teaches an aeration system comprising a main air supply pipe arranged to float on the surface of a body of water which is provided pressurized air via a blower. Flexible hoses decend downward from the air supply pipe and are connected to a plurality of submerged conduits, the conduits each including a plurality of air diffusers. Thus, the device includes a plurality of modules comprising two flexible hoses and a conduit including a plurality of air hoses each connected to the main air supply pipes. In one embodiment, each module is connected to a ballast block by a flexible line that is also connected to the main air supply such that the individual module may be brought to the surface by pulling on the flexible line. In an alternative embodiment, each module includes an inflatable bladder for bringing each individual module to the surface as desired. While in these arrangements, no heavy equipment is needed to bring the individual modules to the surface, it is limited in that each individual module is raised individually, thereby making routine maintenance time consuming. Furthermore, this device is poorly suited for aerating lakes and the like, as the main air supply pipe lies on the surface of the lake, thereby interfering with lake traffic and producing considerable noise.

U.S. Pat. No. 5,690,864 teaches an aeration system for a wastewater treatment plant. The device comprises an air supply pipe for receiving compressed air arranged to float on the surface of the lagoon. Flexible air supply conduits decend downward from the air supply pipe and are each connected at one end to an elongate aerator. Guide members are provided for fixing the location of the elongate aerators relative to the flexible air supply conduits and the bottom of the wastewater basin. As with the above-described, this device is limited in that only one section of the device can be brought to the surface at one time and the device would be poorly suited for aerating lakes and the like as the main air supply pipe would lie across the surface of the lake.

The limitations and inherent difficulties associated with the prior art devices clearly indicate that a method is needed for transporting fluids across a body of water and for aerating bodies of water that is easy to install and service.

SUMMARY OF THE INVENTION

According to one aspect of the invention there is provided a method for transporting a fluid or gas across a body of water, said body of water having a surface and a bottom, said method comprising:

(a) providing a header comprising:
- a first pipe for transporting the fluid;
- a second pipe containing air, said second pipe containing air when the header is floating and water when the header is submerged; and
- ballast means for providing weight to the header, said ballast means arranged such that the header floats on the surface of the body of water when the second pipe is filled with air;

(b) floating the header across the surface of the body of water;

(c) allowing water into the second pipe, thereby displacing the header from the surface of the body of water to the bottom of the body of water; and (d) pumping the fluid into the first pipe, thereby transporting the fluid across the body of water. Thus, the header is initially floated onto the surface of the body of water and then sunk to the bottom of the body of water by increasing the weight of the header by replacing the air in the second pipe with water.

The method may include step (e) returning the header to the surface of the body of water by displacing the water in the second pipe with air. In this manner, the entire header can quickly and easily be returned to the surface of the body of water for service and/or maintenance without the use of large equipment such as cranes and the like or complicated pulley systems that allow only section of the pipeline to be raised at a time.

Preferably, the ballast means comprises a third pipe filled with a ballast.

Preferably, the pipes are interconnected such that the first pipe is above the second pipe and the second pipe is above the third pipe. The pipes may be fused together.

Preferably, the pipes are composed of a plastics material, for example, high density polyethylene. This material has the advantage of being malleable, resistant to corrosive substances, UV light, physical abuse, adhesion of foreign substances and abrasion. Alternatively, any other material having similar characteristics could be used.

According to a second aspect of the invention, there is provided a method for aerating a body of water, said body of water having a surface and a bottom, said method comprising:

(a) providing a header comprising:
  a first pipe for receiving pressurized air;
  a plurality diffusion lines connected to the first pipe for dispersing the pressurized air into the body of water;
  a second pipe containing air; and
  ballast means for providing weight to the header, said ballast means arranged such that the header floats on the surface of the body of water when the second pipe is filled with air;

(b) floating the header across the surface of the body of water;

(c) allowing water into the second pipe, thereby displacing the header from the surface of the body of water to the bottom of the body of water; and (d) pumping the pressurized air into the first pipe and out the diffusion lines, thereby aerating the body of water. Thus, this method may be used to aerate lakes or waste water lagoons.

The method may include step (e) returning the header to the surface of the body of water by displacing the water in the second pipe with air. In this manner, the entire header can quickly and easily be returned to the surface of the body of water for service and/or maintenance without the use of large equipment such as cranes and the like or complicated pulley systems that allow only section of the pipeline to be raised at a time.

Preferably, the ballast means comprises a third pipe filled with a ballast.

Preferably, the pipes are interconnected such that the first pipe is above the second pipe and the second pipe is above the third pipe. The pipes may be fused together.

Preferably, the pipes are composed of a plastics material, for example, high density polyethylene. This material has the advantage of being malleable, resistant to corrosive substances, UV light, physical abuse, adhesion of foreign substances and abrasion. Alternatively, any other material having similar characteristics could be used.

The pressurized air may be used for de-icing the body of water. In this manner, the levels of ice in harbours, canals and shipping lanes in winter conditions could be dramatically reduced.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
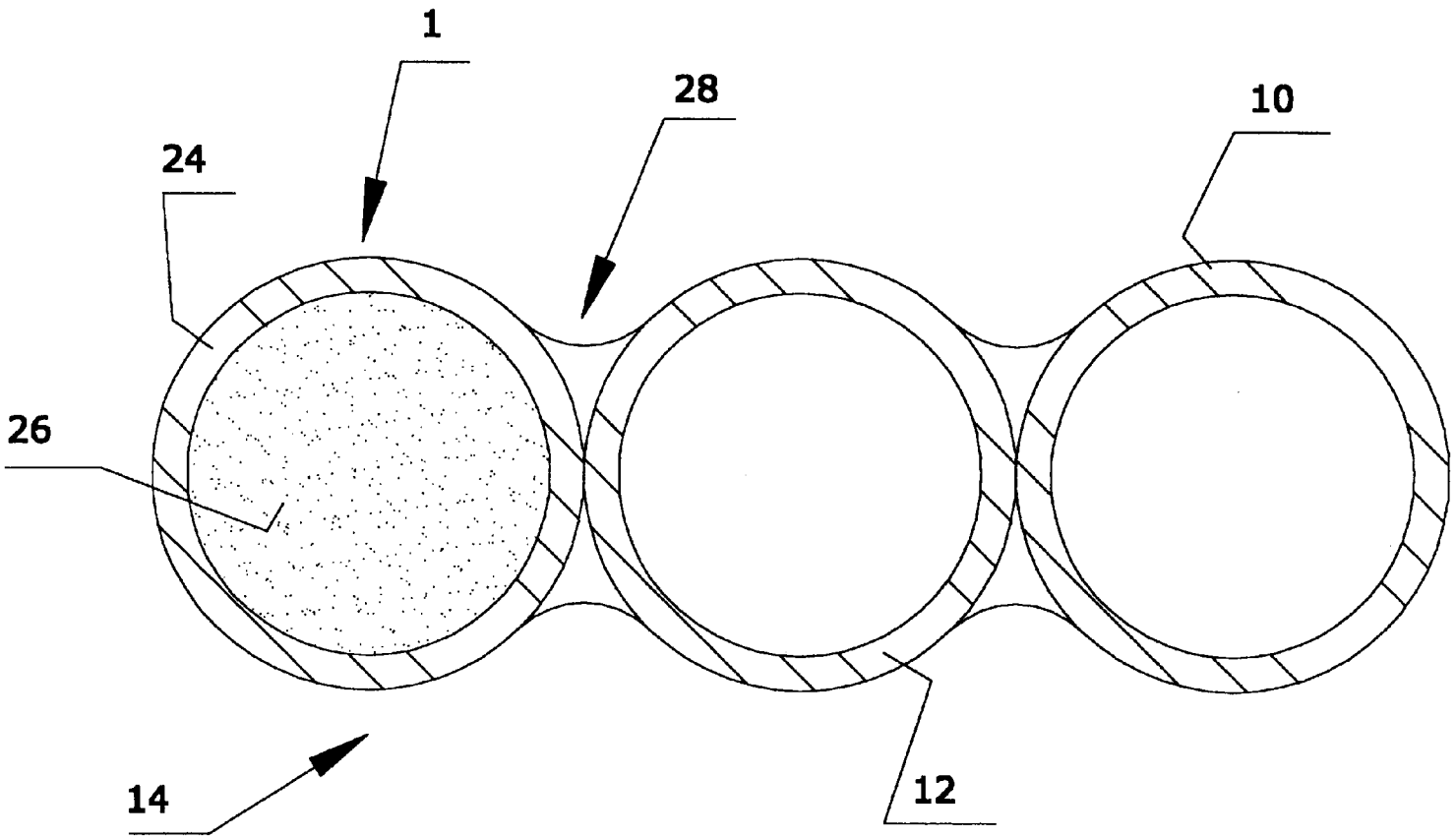
FIG. 1 is a front view in cross section of the header arranged for transmitting a gas or fluid across a body of water.

Referring to the drawings, a float sink header 1 comprises a fluid pipe 10, an air/water pipe 12 and ballast means 14. The fluid pipe 10 comprises a first end 16 and a second end 18 and is arranged to hold a fluid or gas, as described below. The air/water pipe 12 comprises a first end 20 and a second end 22 and is arranged to hold either air or water as described below.

In this embodiment, the ballast means 14 comprises a ballast pipe 24 for containing a ballast material 26, for example, a lineal ballast, a solid ballast or a viscous slurry containing additives for example bentonite clay, polymers and/or calcium chloride mixed with weight materials, for example, powdered barite, lead or bismuth.

In this embodiment, the fluid pipe 10, the air/water pipe 12 and the ballast pipe 24 are composed of a plastics material, for example, high density polyethylene. This material has the advantage of malleability, resistance to damage from corrosive substances, UV light or physical damage, as well as resistance to abrasion or adhesion of foreign substances.

Figure 2:
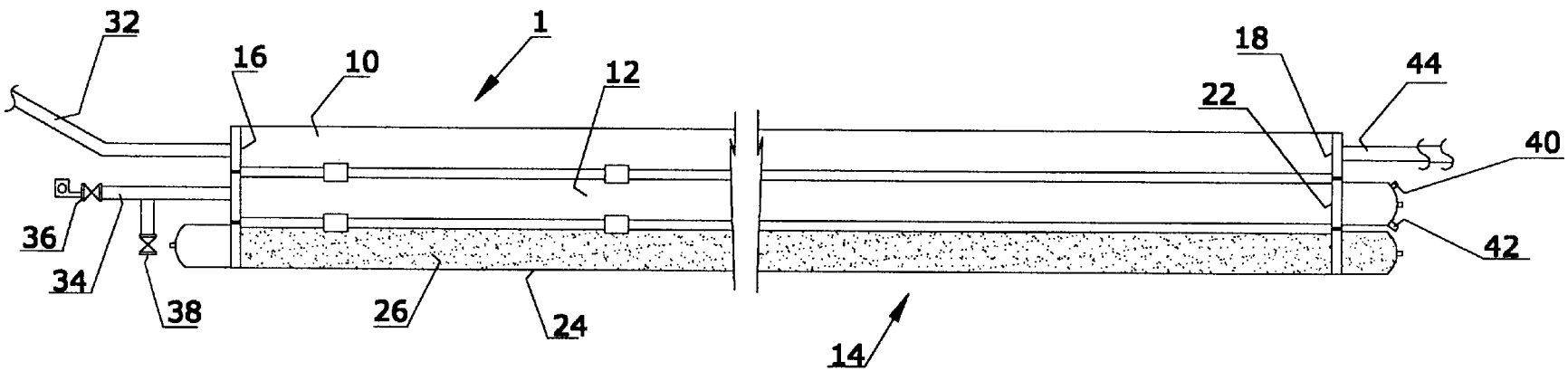
FIG. 2 is a side view of the header arranged for transmitting a gas or fluid across a body of water.
Figure 3:
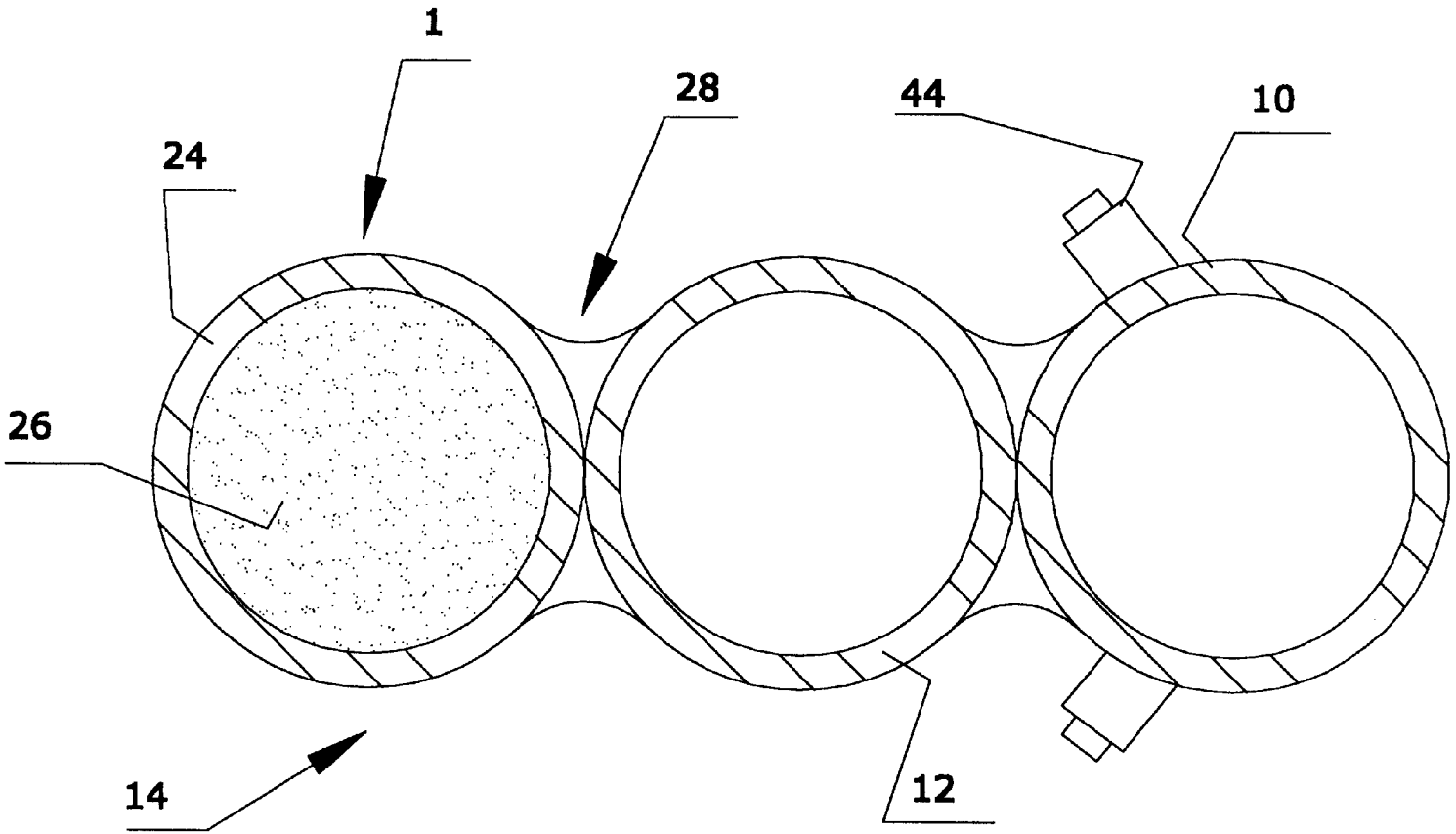
FIG. 3 is a front view in cross section of the header arranged for aerating a body of water.
Figure 4:
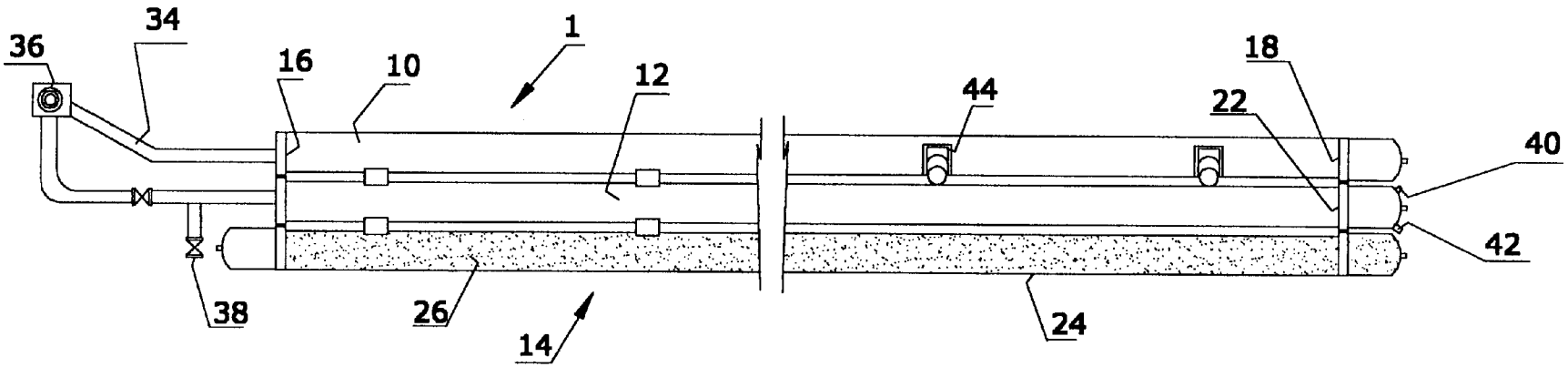
FIG. 4 is a side view of the header arranged for aerating a body of water.

For use, the fluid pipe 10, the air/water pipe 12 and the ballast pipe 24 are joined together by connecting means 28. In this embodiment, the float sink header 1 is arranged such that the fluid pipe 10 is welded to the air/water pipe 12 and the air/water pipe 12 is welded to the ballast pipe 24. Thus, the fluid pipe 10 is above the air/water pipe 12 and the air/water pipe 12 is above the ballast pipe 24, as shown in FIG. 1. The ballast pipe 24 is then filled with the ballast material 26 and the ends of the ballast pipe 24 are sealed. It is of note that the ballast material 26 is prepared so as to provide sufficient weight that the float sink header 1 will float when the air/water pipe 12 is filled with air and the float sink header 1 will sink when the air/water pipe 12 is filled with water, as described below. The first end 20 of the air/water pipe 12 is then connected to a hose 34 connected to an air pump 36 and a water pump 38 as shown in FIG. 2, for floating or sinking the float sink header 1 as described below. Furthermore, the second end 22 of the air/water pipe 12 is sealed and includes an air valve 40 and a water valve 42 for exit of air or water respectively from the air/water pipe 12 as described below. It is of note that in this embodiment, the air/water pipe 12 is initially filled with air.

In one embodiment, the float sink header 1 is arranged for transporting a fluid 30, for example, liquid hydrocarbons, natural gas, oil or air, across a body of water as shown in FIGS. 1 and 2. In this embodiment, the first end 16 of the fluid pipe 10 is connected to a supply hose 32 which is in turn connected to a ground-based pipeline on a first side of the body of water, as shown in FIG. 2. The float sink header 1 is then laid out across the body of water. As noted above, the ballast pipe 24 is filled with ballast material 26 such that the float sink header 1 floats on the surface of the body of water when the air/water pipe 12 is filled with air. Once the float sink header 1 is laid out over the surface of the body of water, the second end 18 of the fluid pipe 10 is connected via a hose 44 to a pipeline on the opposite side of the body of water. Thus, the two pipelines on either side of the body of water are now connected by the fluid pipe 10 of the float sink header 1.

In use, the air valve 40 is opened so that the air exits the air/water pipe 12 and water from the body of water enters the air/water pipe 12. As the air/water pipe 12 fills with water, the specific weight of the float sink header 1 increases, thereby causing the float sink header 1 to sink to the bottom of the body of water. The fluid 30 is then pumped from the from the first side of the body of water to the second side of the body of water.

When the float sink header 1 is to be serviced or if there are concerns regarding leaks, compressed air is pumped into the air/water pipe 12 via the air pump 36. Specifically, the air forces the water to exit the air/water pipe via the water valve 42, thereby causing the float sink header 1 to rise to the surface of the body of water. As noted above, the ballast material 26 is prepared such that the float sink header 1 will float when the air/water pipe 12 is filled with air. As a result of this arrangement, the entire pipeline can be serviced at once with the float sink header 1 on the surface of the body of water. This eliminates the need for expensive underwater welding or lifting equipment and greatly reduces the time required to examine the entire length of the underwater pipeline, that is, the float sink header 1.

Figure 5:
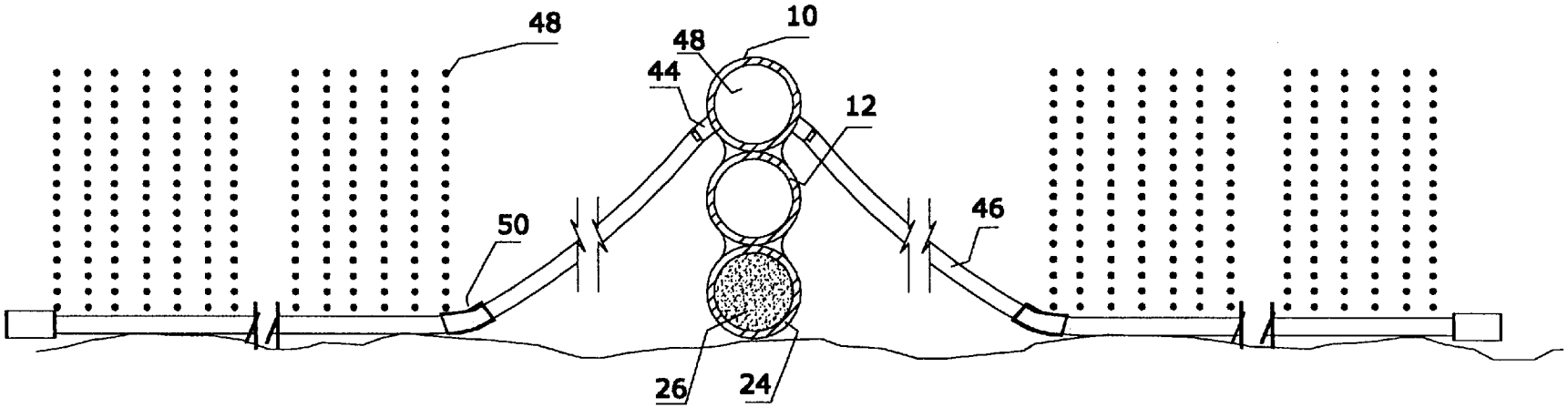
FIG. 5 is a front view in cross section of the header aerating a body of water along the bottom of the body of water.
Figure 6:
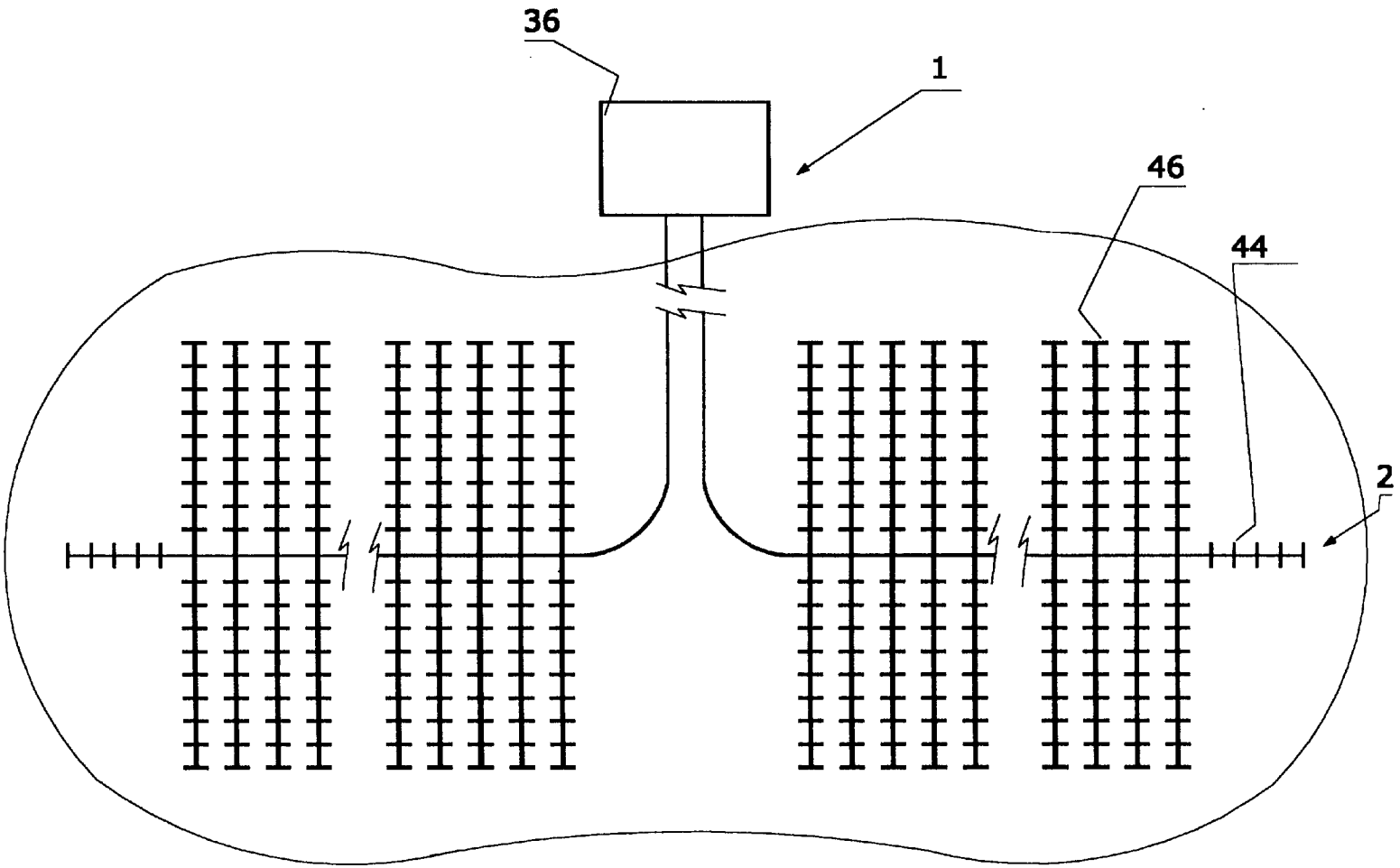
FIG. 6 is a top view of the header aerating a body of water.

In another embodiment, the float sink header 1 is arranged for aerating a body of water, for example, a waste water lagoon or lake, as shown in FIGS. 3–6. In this embodiment, the fluid pipe 10 includes a plurality of ports 44 disposed on either side of the fluid pipe 10 along the entire length of the fluid pipe 10 and diffuser lines 46 connected to each port 44. In one embodiment, the ports 44 are positioned on the fluid pipe at 30 meter intervals. The ports 44 are arranged to expel air 48 from the fluid pipe 10. The diffuser lines 46 are connected to ports 44 such that the diffuser lines 46 extend outwardly therefrom. In one embodiment, the diffuser lines 46 are approximately 90 meters long. Furthermore, the diffuser lines 46 include a plurality of apertures 50 for dispersing the air into the body of water. In this embodiment, the first end 16 of the fluid pipe 10 is connected to a supply hose 32 which is in turn connected to the air pump 36. The float sink header 1 is then laid out across the body of water such that the diffuser lines 46 extend outwardly from the float sink header 1, as shown in FIG. 6. As noted above, the ballast pipe 24 is filled with ballast material 26 such that the float sink header 1 floats on the surface of the body of water when the air/water pipe 12 is filled with air.

In use, the air valve 40 is opened so that the air exits the air/water pipe 12 and water from the body of water enters the air/water pipe 12. As the air/water pipe fills with water, the specific weight of the float sink header 1 increases, thereby causing the float sink header 1 to sink to the bottom of the body of water. As a result, the diffuser lines 46 lie along the bottom of the body of water, as shown in FIGS. 5 and 6. Air 48 is then pumped into the fluid pipe 10 via the air pump 38. As noted above, the compressed air 48 exits the fluid pipe 10 via the ports 44 and enters the diffuser lines 46. The air 48 exits the diffuser lines 46 via the apertures 50 in the diffuser lines 46, thereby aerating the body of water.

When the float sink header 1 is to be serviced or if there are concerns regarding leaks, compressed air is pumped into the air/water pipe 12 via the air pump 36. Specifically, the air forces the water to exit the air/water pipe via the water valve 42, thereby causing the float sink header 1 to rise to the surface of the body of water. As noted above, the ballast material 26 is prepared such that the float sink header 1 will float when the air/water pipe 12 is filled with air. As a result of this arrangement, the entire pipeline can be serviced at once while the float sink header 1 is on the surface of the body of water. This eliminates the need for expensive underwater welding or lifting equipment and greatly reduces the time required to examine the entire pipeline, that is, the float sink header 1.

Figure 7:
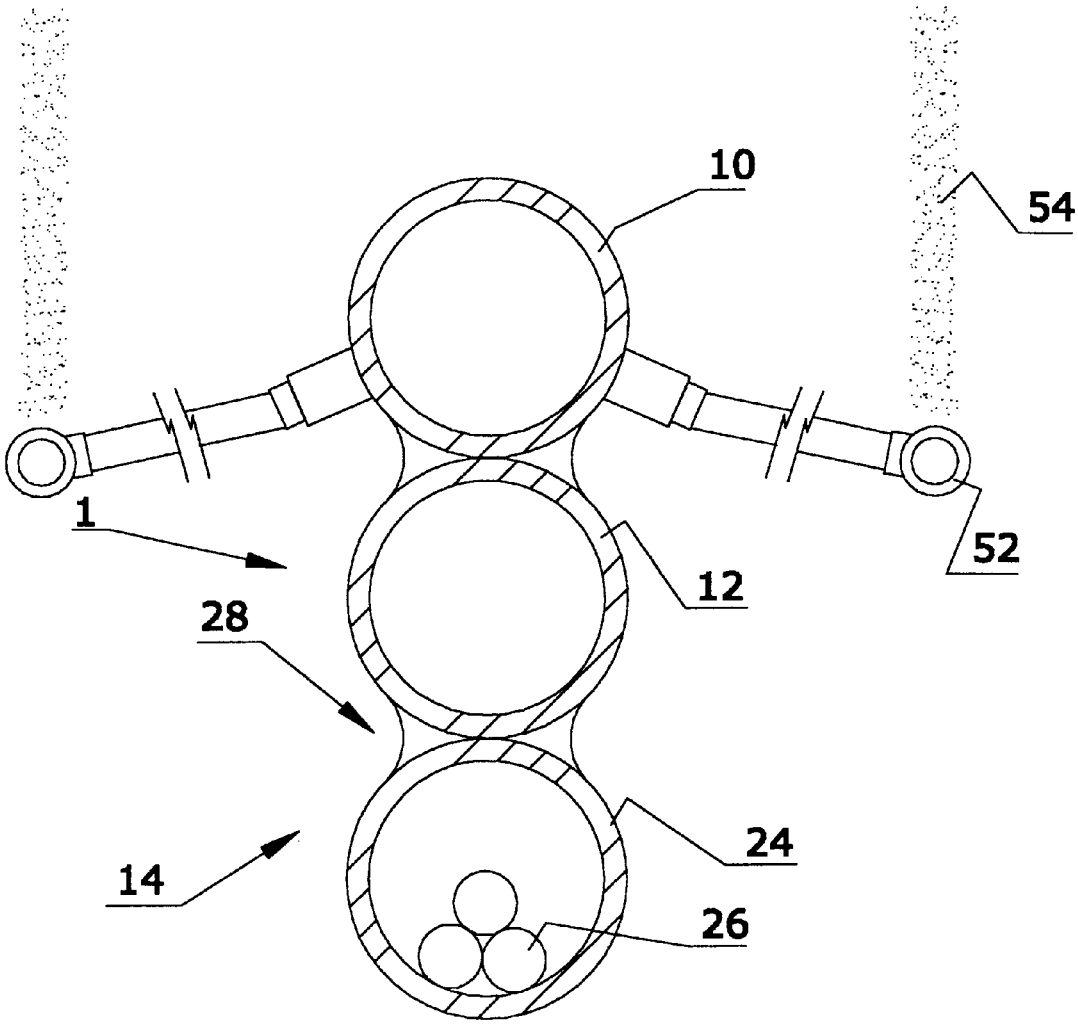
FIG. 7 is a side view of the header arranged for de-icing a body of water.
Figure 8:
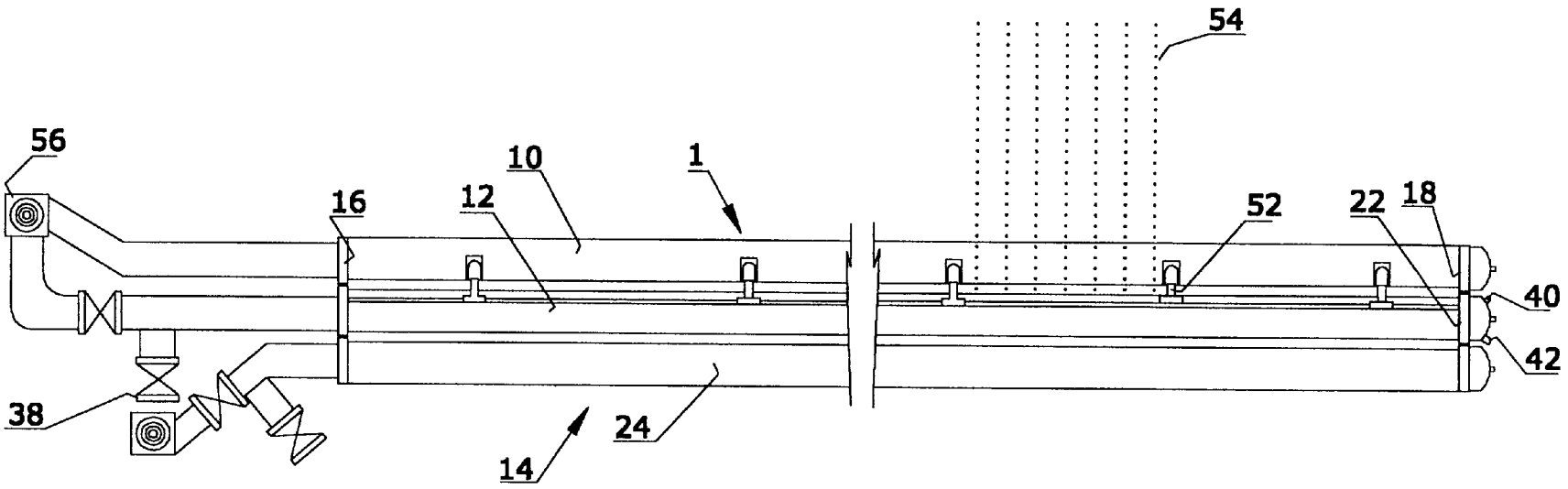
FIG. 8 is a side view of the header arranged for de-icing a body of water.

In another embodiment, the float sink header 1 is arranged for de-icing a body of water, for example, a river, channel or lake for facilitating shipping in winter conditions. In this embodiment, the fluid pipe 10 includes a plurality of conduits 52 disposed on either side of the fluid pipe 10 along the entire length of the fluid pipe 10 as shown in FIG. 7. The conduits 52 are arranged to expel heated air, 54 from the fluid pipe 10. In this embodiment, the first end 16 of the fluid pipe 10 is connected to a supply hose 32 which is in turn connected to a compressed air pump 56 for providing heated air. The float sink header 1 is then laid out across the body of water. As noted above, the ballast pipe 24 is filled with ballast material 26 such that the float sink header 1 floats on the surface of the body of water when the air/water pipe 12 is filled with air.

Figure 9:
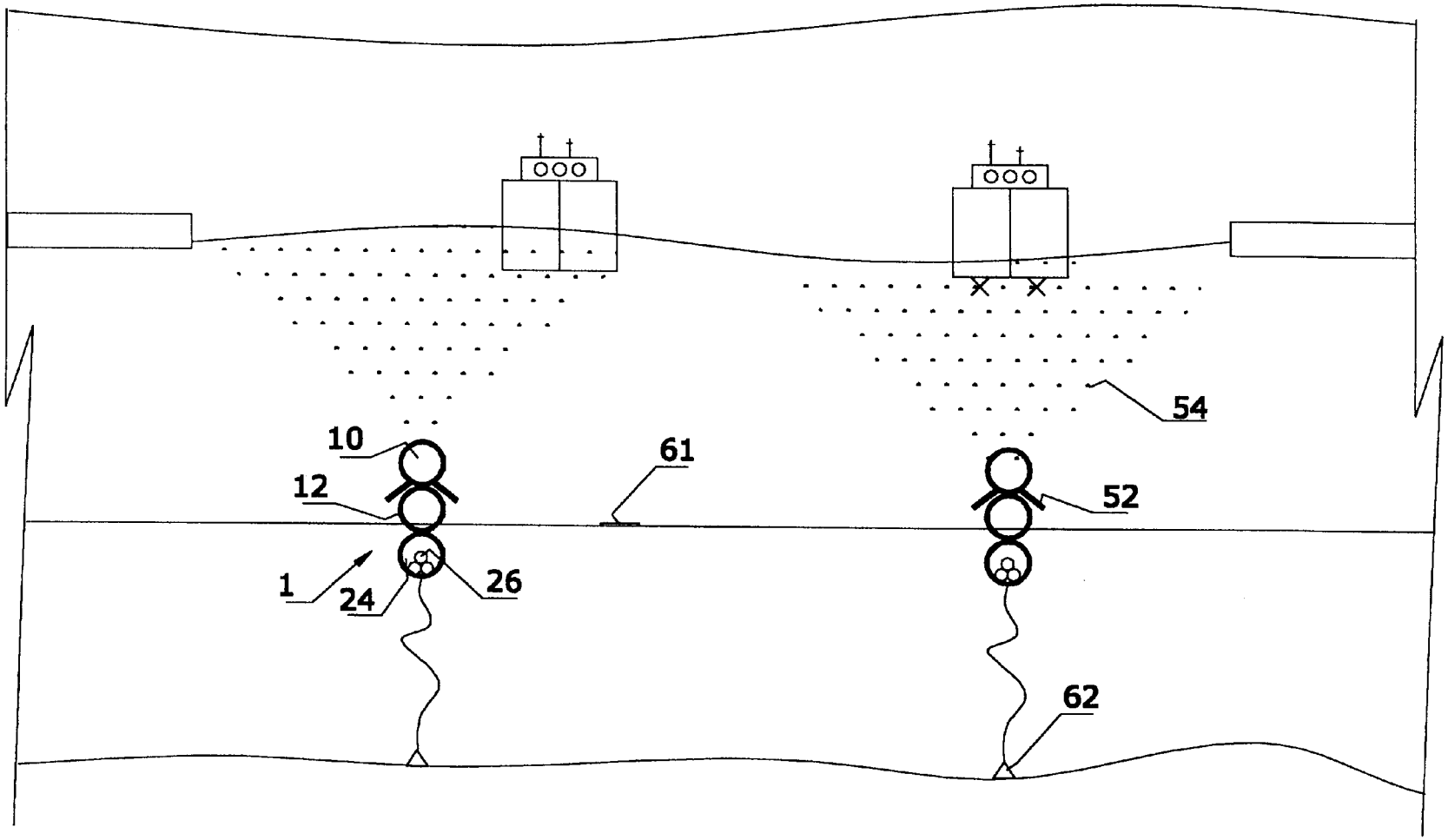
FIG. 9 is a front view in cross section of the header de-icing a body of water.

In use, the air valve 40 is opened so that the air exits the air/water pipe 12 and water from the body of water enters the air/water pipe 12. As the air/water pipe fills with water, the specific weight of the float sink header 1 increases, thereby causing the float sink header 1 to sink below the surface of the body of water. Compressed air 54 is then pumped into the fluid pipe 10 by the compressed air pump 56. The compressed air 54 exits the fluid pipe 10 via the conduits 52, thereby reducing ice 60 on the body of water, as shown in FIG. 9. It is of note that multiple float sink headers 1 may be arranged parallel to one another and tethered together by a line 61 for de-icing larger bodies of water. Furthermore, the float sink header 1 may include anchors 62 for fixing the position of the respective float sink headers 1.

When the float sink header 1 is to be serviced or if there are concerns regarding leaks, compressed air is pumped into the air/water pipe 12 via the air pump 56. Specifically, the air forces the water to exit the air/water pipe via the water valve 42, thereby causing the float sink header 1 to rise to the surface of the body of water. As noted above, the ballast material 26 is prepared such that the float sink header 1 will float when the air/water pipe 12 is filled with air. As a result of this arrangement, the entire pipeline can be serviced at once on the surface of the body of water. As a result, there is no need for expensive underwater welding or lifting equipment to service the underwater pipeline, that is, the float sink header 1.

Alternatively, water may be pumped into the air/water pipe 12 via a water pump for submerging the float sink header 1. In this embodiment, the incoming water forces the air in the air/water pipe 12 out of the air/water pipe 12 through the air valve 40. As the air/water pipe 12 fills with water, the float sink header 1 is submerged beneath the surface of the body of water, as described above.

In an alternative embodiment shown in FIG. 7, the ballast material 26 comprises a lineal ballast and air. In this embodiment, the float sink header 1 is arranged to have neutral buoyancy when the air/water pipe 12 is filled with water. The depth at which the float sink header 1 is suspended in the body of water is determined by the interaction between the density of the air in the ballast pipe 24 and, which is increased to cause the float sink header 1 to submerge, and the density of the air in the fluid pipe 10, which increases as the float sink header 1 sinks. Once the target depth is attained, pressure and density of the air in the ballast pipe 24 is carefully reduced to stop the descent of the float sink header 1 so that the float sink header attains equilibrium. In this embodiment, the float sink header 1 is brought to the surface by decreasing the buoyancy of the float sink header 1, for example, by removing the air from the fluid pipe 10.

Alternatively, the ballast material may comprise a pumpable ballast for filling long ballast pipes. In this embodiment, the pumpable ballast comprises a water-based, thick, viscous slurry composed of additives, for example, bentonite clay and polymers, and weight materials, for example, powdered barite, lead or bismuth. The additives act to prevent the weight materials from migrating or settling within the ballast pipe. The pumpable ballast is selected so as to be chemically and biologically inert and behaves as a Newtonian fluid when disturbed but as a semi-solid non-Newtonian fluid when at rest, which prevents the weight materials from migrating within the ballast pipe. Yet further, the pumpable ballast may include additives, for example, calcium chloride, for preventing freezing if the float sink header was exposed to sub-zero temperatures.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A method for aerating a body of water, said body of water having a surface and a bottom, said method comprising:

providing an elongate header including:

providing on the header a first elongate pipe for receiving pressurized air;

providing a plurality of air discharge members on the first pipe at spaced positions along a length of the first pipe for dispersing the pressurized air into the body of water;

providing on the header a second elongate pipe extending along the full length of the first pipe;

providing on the header an elongate ballast member for providing weight to the header, said ballast member extending along the full length of the first pipe;

the second pipe and the ballast member being connected to the first pipe so as to extend parallel to and directly along side the first pipe such that the first pipe, the second pipe and the ballast member are substantially coextensive along the full length of the header;

injecting air into the second pipe to act as a float and arranging the ballast member and the second pipe when injected with air such that the header floats and floating the header across the surface of the body of water;

causing water to enter into the second pipe and arranging the ballast member and the second pipe when water has entered into the second pipe such that the header sinks from the surface of the body of water to the bottom of the body of water;

and pumping the pressurized air into the first pipe and out the air discharge members thereby aerating the body of water.

2. A method for aerating a body of water, said body of water having a surface and a bottom, said method comprising:

providing an elongate header including:

providing on the header a first elongate pipe extending along a full length of the header for receiving pressurized air;

providing a plurality of air discharge members on the first pipe at spaced positions along a length of the first pipe for dispersing the pressurized air into the body of water;

providing on the header a second elongate pipe extending along the full length of the header;

providing on the header a third elongate pipe extending along the full length of the header and filling the third pipe with a ballast material;

the second pipe and the third pipe being connected to the first pipe so as to extend parallel to and directly along side the first pipe such that the first pipe, the second pipe and the third pipe are substantially coextensive along the full length of the header;

injecting air into the second pipe to act as a float and arranging the ballast material and the second pipe when injected with air such that the header floats and floating the header across the surface of the body of water;

causing water to enter into the second pipe and arranging the ballast material and the second pipe when water has entered into the second pipe such that the header sinks from the surface of the body of water to the bottom of the body of water;

and pumping the pressurized air into the first pipe and out the air discharge members thereby aerating the body of water.

3. The method according to claim 2 wherein the pipes are interconnected such that the first pipe is above the second pipe and the second pipe is above the third pipe.

4. The method according to claim 3 wherein the pipes are attached together along their full length.

5. A method for aerating a body of water, said body of water having a surface and a bottom, said method comprising:

providing an elongate header including:

providing on the header a first elongate pipe for receiving pressurized air;

providing a plurality of air discharge members on the first pipe at spaced positions along a length of the first pipe for dispersing the pressurized air into the body of water;

providing on the header a second elongate pipe extending along the full length of the first pipe;

providing on the header a ballast member for providing weight to the header, said ballast member extending along the full length of the first pipe;

the second pipe and the ballast member being connected to the first pipe so as to extend parallel to and directly along side the first pipe such that the first pipe, the second pipe and the ballast member are substantially coextensive along the full length of the header;

the header thus consisting of a single first pipe, a single second pipe and a single ballast member;

injecting air into the second pipe to act as a float and arranging the ballast member and the second pipe when injected with air such that the header floats and floating the header across the surface of the body of water;

causing water to enter into the second pipe and arranging the ballast member and the second pipe when water has entered into the second pipe such that the header sinks from the surface of the body of water to the bottom of the body of water;

and pumping the pressurized air into the first pipe and out the air discharge members thereby aerating the body of water.

6. A method for aerating a body of water, said body of water having a surface and a bottom, said method comprising:

providing an elongate header including:

providing on the header a first elongate pipe extending along a full length of the header for receiving pressurized air;

providing a plurality of air discharge members on the first pipe at spaced positions along a length of the first pipe for dispersing the pressurized air into the body of water;

the air discharge members comprising a first plurality of elongate diffuser lines extending from the first pipe outwardly to one side of the header and lying along the bottom and a second plurality of elongate diffuser lines extending from the first pipe outwardly to an opposed side of the header and lying along the bottom;

providing on the header a second elongate pipe extending along the full length of the header;

providing on the header ballast means for providing weight to the header, said ballast means extending along the full length of the header;

the second pipe and the ballast means being connected to the first pipe so as to extend parallel to and directly along side the first pipe such that the first pipe, the second pipe and the ballast means are substantially coextensive along the full length of the header;

injecting air into the second pipe to act as a float and arranging the ballast member and the second pipe when injected with air such that the header floats and floating the header across the surface of the body of water;

causing water to enter into the second pipe and arranging the ballast member and the second pipe when water has entered into the second pipe such that the header sinks from the surface of the body of water to the bottom of the body of water;

and pumping the pressurized air into the first pipe and out the air discharge members thereby aerating the body of water.

7. A method for aerating a body of water, said body of water having a surface and a bottom, said method comprising:

providing an elongate header including:

providing on the header a first elongate pipe for receiving pressurized air;

providing a plurality of air discharge members on the first pipe at spaced positions along a length of the first pipe for dispersing the pressurized air into the body of water;

the air discharge members comprising a first elongate diffuser line extending along the first pipe on a first side of the header and connected to the first pipe at spaced positions therealong and a second elongate diffuser line extending along the first pipe on a second side of the header and connected to the first pipe at spaced positions therealong;

providing on the header a second elongate pipe extending along the full length of the first pipe;

providing on the header ballast means for providing weight to the header, said ballast means extending along the full length of the fist pipe;

the second pipe and the ballast means being connected to the first pipe so as to extend parallel to and directly along side the first pipe such that the first pipe, the second pipe and the ballast means are substantially coextensive along the full length of the header;

injecting air into the second pipe to act as a float and arranging the ballast member and the second pipe when injected with air such that the header floats and floating the header across the surface of the body of water;

causing water to enter into the second pipe and arranging the ballast member and the second pipe when water has entered into the second pipe such that the header sinks from the surface of the body of water to the bottom of the body of water;

and pumping the pressurized air into the first pipe and out the air discharge members thereby aerating the body of water.

* * * * *